US005367443A

United States Patent [19]

Hara

[11] Patent Number: 5,367,443

[45] Date of Patent: Nov. 22, 1994

[54] MINIATURE LAMP

[75] Inventor: Kanichi Hara, Tokyo, Japan

[73] Assignee: Minami International Corporation, Yonkers, N.Y.

[21] Appl. No.: 143,486

[22] Filed: Oct. 27, 1993

[51] Int. Cl.[5] ..... F21V 21/00

[52] U.S. Cl. ..... 362/227; 362/249; 362/800; 313/51; 313/318

[58] Field of Search ..... 313/318, 51; 439/611, 439/617; 362/227, 249, 800

[56] References Cited

U.S. PATENT DOCUMENTS

| | | | |
|---|---|---|---|
| 804,387 | 11/1905 | Davis . | |
| 1,616,654 | 2/1927 | Gammeter . | |
| 1,905,843 | 4/1933 | Foulke . | |
| 2,462,530 | 2/1949 | Miller . | |
| 3,182,185 | 5/1965 | Ahroni . | |
| 3,671,923 | 6/1972 | Rieth . | |
| 4,228,486 | 10/1980 | Matsuya . | |
| 4,234,915 | 11/1980 | Malinowski et al. . | |
| 4,241,387 | 12/1980 | Bowers . | |
| 4,318,158 | 3/1982 | Livermore et al. . | |
| 4,471,414 | 9/1984 | Savage . | |
| 4,599,682 | 7/1986 | Stephens . | |
| 4,603,278 | 7/1986 | Devir et al. . | |
| 4,647,132 | 3/1987 | Mikola . | |
| 4,679,126 | 10/1991 | Van Sickler . | |
| 4,803,396 | 2/1989 | Kelner | 313/318 |
| 5,001,615 | 3/1991 | Stefanelli | 439/611 |
| 5,278,741 | 1/1994 | Ehrman | 362/249 |
| 5,291,092 | 3/1994 | Coushaine | 313/318 |

FOREIGN PATENT DOCUMENTS

| | | |
|---|---|---|
| 2217179 | 8/1973 | Germany . |
| 940600 | 2/1971 | Japan . |
| 109269 | 8/1979 | Japan . |
| 6220282 | 2/1973 | Taiwan, Prov. of China . |
| 1055631 | 7/1967 | United Kingdom . |
| 2105531 | 3/1983 | United Kingdom . |

*Primary Examiner*—Carroll B. Dority

*Attorney, Agent, or Firm*—Amster, Rothstein & Ebenstein

[57] ABSTRACT

A miniature lamp for use in a holder, includes a miniature bulb and a longitudinally-extending base. The base in turn includes a body defining an outer surface and an open-top cavity configured and dimensioned to receive a portion of the bulb therein, and a cantilever projecting generally longitudinally from the body. The cantilever is movable between a releasing orientation and a locking orientation, the cantilever in the releasing orientation enabling at least limited relative rotation of the bulb and the base and in the locking orientation precluding such relative rotation. The cantilever is biased to the releasing orientation and automatically assumes the locking orientation when the base is inserted into a holder. Dumet leads extend from the bulb portion in the cavity, through the body, and onto the body outer surface.

18 Claims, 3 Drawing Sheets

FIG. 4
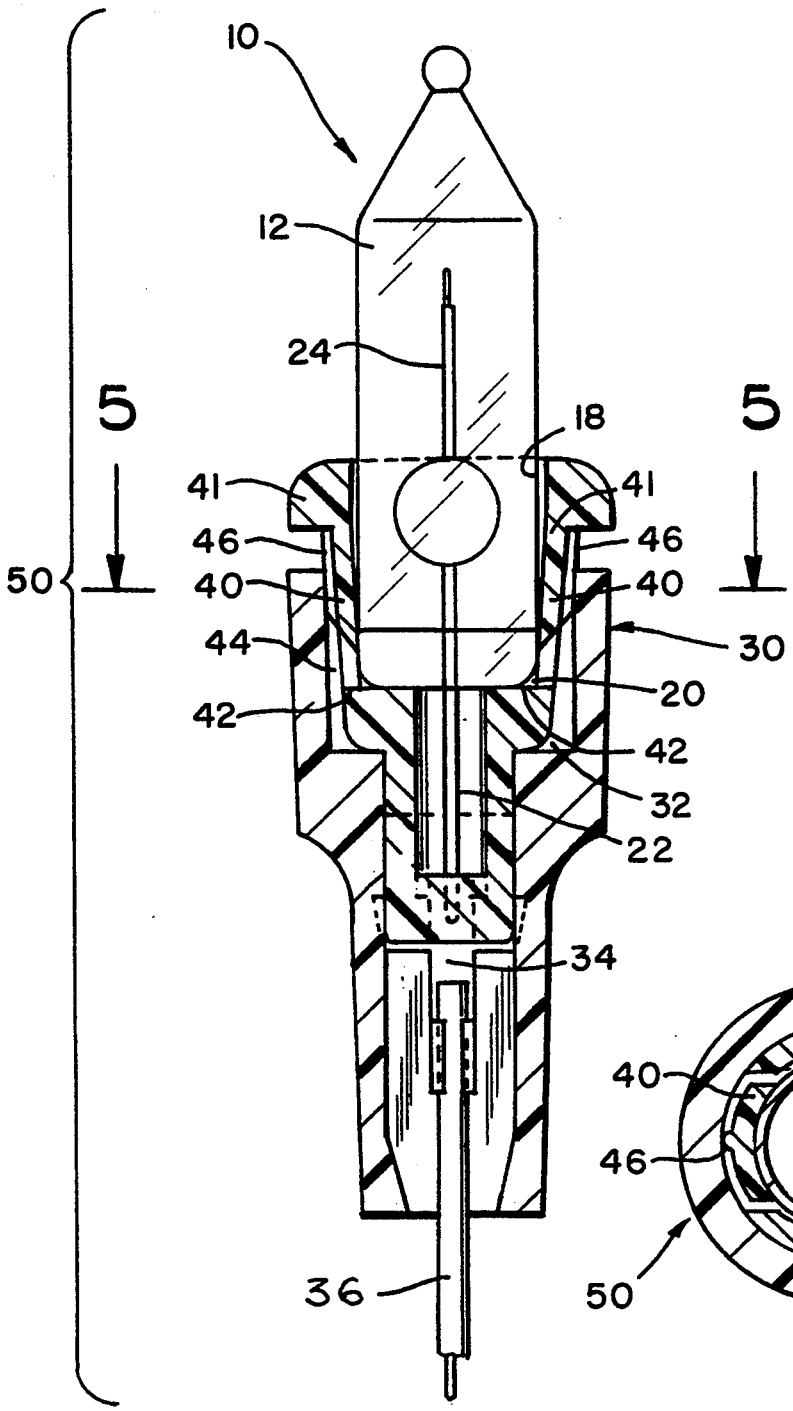
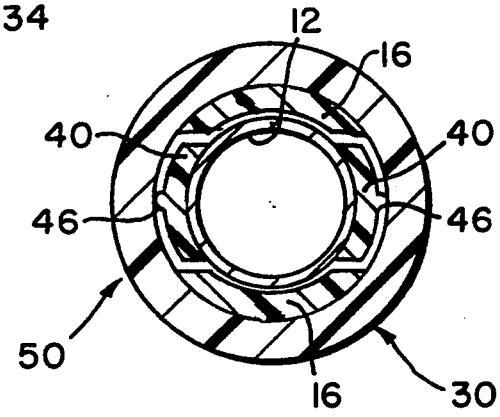
FIG. 5

MINIATURE LAMP

BACKGROUND OF THE INVENTION

The present invention relates to miniature push-in lamps for use in a holder, and more particularly to a miniature push-in lamp designed to preclude relative rotation of the bulb and the base, thereby to prevent breakage or displacement the dumet leads.

Miniature lamps are used for the decoration of Christmas trees, commercial displays and the like and, depending upon their size, are known by a variety of different names related to their size. The miniature push-in lamp is an assembly composed of a miniature push-in bulb and a longitudinally extending base. The base includes a body defining an outer surface and an open-top cavity configured and dimensioned to receive a bottom portion of the bulb therein. The bottom of the miniature push-in lamp is configured and dimensioned to be received in a holder therefor so as to provide both electrical communication between the bulb and a power supply associated with the holder and a secure but releasable physical attachment of the lamp and the holder. The base is typically formed of an electrically insulative plastic with the cavity thereof being configured and dimensioned to receive the bulb portion with a push-in (non-rotational) insertion motion. In order to facilitate insertion of the bulb portion into the base cavity, the body typically does not apply to the bulb sufficient frictional forces to preclude relative rotation of the bulb and the body.

In order to provide an electrical connection between the bulb and the holder, dumet leads are provided. These dumet leads are uninsulated thin, flexible wires having one end physically secured to and in electrical communication with the electrical circuitry or filament of the bulb, a main body extending from the bulb portion in the cavity through the body of the base, and the other end disposed on the body outer surface for electrical communication with the electrical contacts of the holder when the lamp is inserted into the holder. Typically, the bottom portion of the body of the base is somewhat wedged shaped with one end of each dumet lead being disposed on a respective one of the small flat outer side surfaces thereof, the base being inserted into the holder with a push-in (non-rotational) insertion motion.

The conventional miniature lamps have not been entirely satisfactory in use. Because the bulb is capable of at least limited rotation relative to the base either during the process of inserting the lamp into the holder or during use of the lamp, the bulb and base may undergo a degree of relative rotation which results in breakage of one or both dumet leads, dumet lead separation from the bulb, and/or repositioning of the dumet lead on the base outer surface such that it is no longer properly positioned for contact with the holder contact. To overcome this problem, a portion of the base body underneath the base outer surface has been cut away so that the remaining strip of the base outer surface (overlying the cut-out portion) can be caused to flex inwardly by the holder when the lamp is inserted into the holder. The locking strip is capable of flexing or bowing inwardly sufficiently to frictionally engage the bulb, thereby to preclude relative rotation of the bulb and the base body.

In order to be effective, however, the lamp must be inserted into the holder to a predetermined depth to assure both appropriate electrical communication (between the dumet leads and the holder contacts) and appropriate physical security (so that the lamp does not fall out of the holder). However, the locking strip provides such a strong resistance to bowing or deflection inwardly that the consumer often fails to insert the base of the lamp to the necessary depth within the cavity of the holder. Presumably, the severe resistance to insertion (i.e., the inward bowing of the strip) is interpreted by the consumer as an indication that the lamp has already reached the limit of its insertability. Thus, while such a lamp upon appropriate insertion into the holder may limit relative rotation between the holder and the base body (and thereby avoid breakage of the dumet leads, their separation from the bulb, and/or their repositioning on the base outer surface), an appropriate full insertion is often not achieved. As a result, either the lamp is likely to become dislodged from the holder or relative rotation between the bulb and the base remains possible.

Furthermore, while the locking strip operates satisfactorily on an appropriately sized bulb to preclude relative rotation between the bulb and the base, there is frequently a substantial variation in the diameter of the commercially available bulbs which range from 4.5–5.5 millimeters in thickness. Strips which are designed to preclude relative rotation of bulbs in the higher diameter range may not effectively preclude relative rotation of bulbs having a diameter in the lower range.

Accordingly, it is the object of the present invention to provide a miniature lamp for use in a holder wherein relative rotation of the bulb and the base body is; precluded when the base is within a holder.

Another object is to provide such a lamp where the base can accommodate minor variations in bulb diameter and still preclude such relative rotation of the bulb and the base body when the base is within a holder.

A further object is to provide such a lamp which is easily insertable into the holder to the desired depth.

It is an object of the present invention to provide in combination such a lamp and a holder therefor.

It is another object to provide such a combination including a releasable locking mechanism for securing the lamp base and holder together.

It is a further object to provide a set or string of lights formed of such combinations.

It is a final object to provide such a lamp and combination which are easy and inexpensive to manufacture, use and maintain.

SUMMARY OF THE INVENTION

It has now been found that the above and related objects of the present invention are obtained in a miniature lamp for use in a holder. The lamp comprises an assembly of a miniature bulb, a longitudinally-extending base, and dumet leads. The longitudinally-extending base includes a body defining an outer surface and an open-top cavity configured and dimensioned to receive a portion of the bulb therein, and a cantilever projecting generally longitudinally from the body. The cantilever is movable between a releasing orientation and a locking orientation, the cantilever in the releasing orientation enabling at least limited relative rotation of the bulb and the base and in the locking orientation precluding such relative rotation. The cantilever is biased to the releasing orientation and automatically assumes the locking orientation when the base is inserted into a holder. Dumet leads extend from the bulb portion in the cavity, through the body, and onto the body outer surface.

In a preferred embodiment, the cantilever extends longitudinally from adjacent the top of the body downwardly and terminates in a free end. In the locking position the cantilever free end frictionally engages the bulb to preclude relative rotation of the bulb and the base. A diametrically opposed pair of the cantilevers may be used. Optional compressible projecting means on the cantilever function as a spring and enable the cantilever in the locking orientation to preclude such relative rotation with bulbs of differing diameters. The compressible projecting means extends outwardly from an outer surface of the cantilever.

The present invention also encompasses the lamp in combination with a holder therefor, the base being disposed in the holder and the cantilever being held in the locking orientation by the holder. In the combination the holder comprises an insulative body defining an open-top cavity receiving a portion of the base therein and maintaining the cantilever in the locking orientation. The holder also includes conductive contacts in electrical contact with the dumet leads within the holder cavity, and conductive leads in electrical contact with the conductive contacts within the holder body and extending outwardly from the holder body. Preferably the combination additionally includes means for releasably locking the lamp and the holder together.

The present invention further encompasses an ornamental light set (like a Christmas tree set) made from an interconnected plurality of combinations in accordance with the present invention. The set of lights comprises a plurality of the combinations physically and electrically interconnected by the holder leads.

BRIEF DESCRIPTION OF THE DRAWING

The above and related objects, features and advantages of the present invention will be more fully understood with reference to the following detailed description of the presently preferred, albeit illustrative, embodiments of the present invention when taken in conjunction with the accompanying drawing wherein:

FIG. 4 is an elevational sectional view taken along the line 4—4 of FIG. 3; and FIG. 5 is a plan sectional view taken along the line 5—5 of FIG. 4.

DETAILED DESCRIPTION OF THE PREFERRED EMBODIMENTS

Figure 1:
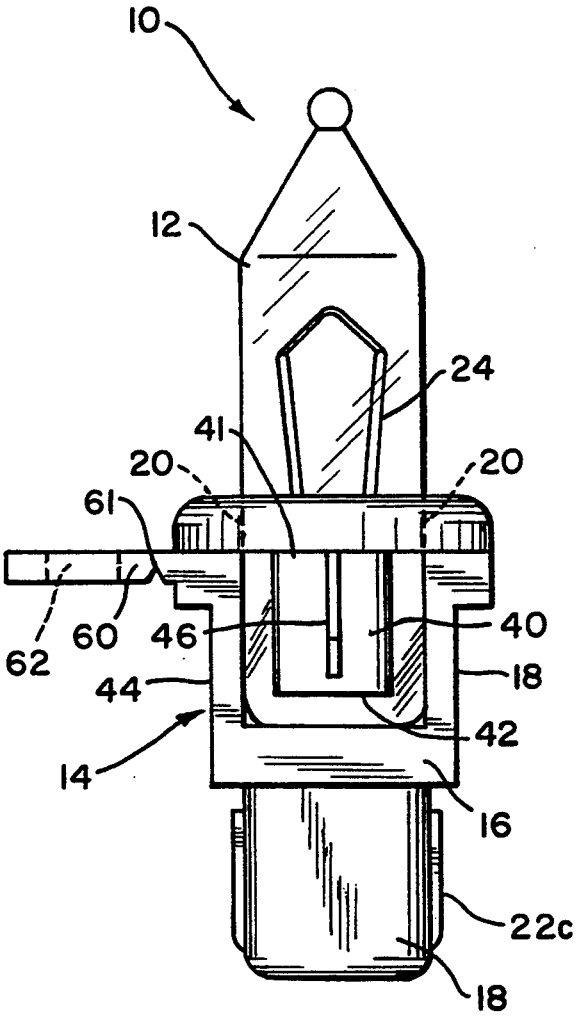
FIGS. 1 and 2 are side and rear elevational views, respectively, of the miniature lamp.
Figure 2:
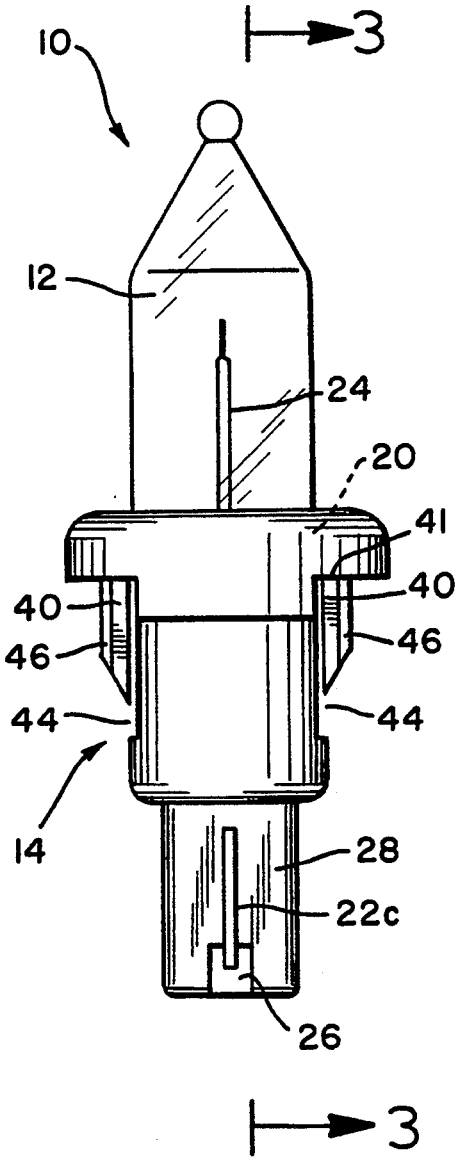

Referring now to the drawing, and in particular to FIGS. 1 and 2 thereof, therein illustrated is a miniature lamp according to the present invention, generally designated by the reference numeral 10. In its conventional aspects, the lamp 10 comprises an assembly including a miniature bulb 12 and a longitudinally-extending base generally designated 14.

The base 14 includes a body 16 defining an outer surface 18 and an open-top cavity 20 configured and dimensioned to releasably receive a bottom portion of the bulb 12 therein. The bulb 12 may be any of the commercially available push-in miniature bulbs which are non-rotationally inserted into base cavity 20. (Actually the bulb 12 and base 14 may accidentally undergo some relative rotation during the insertion process, but there is no relative rotation in the sense of a threaded engagement between the bulb and the base.)

Figure 3:
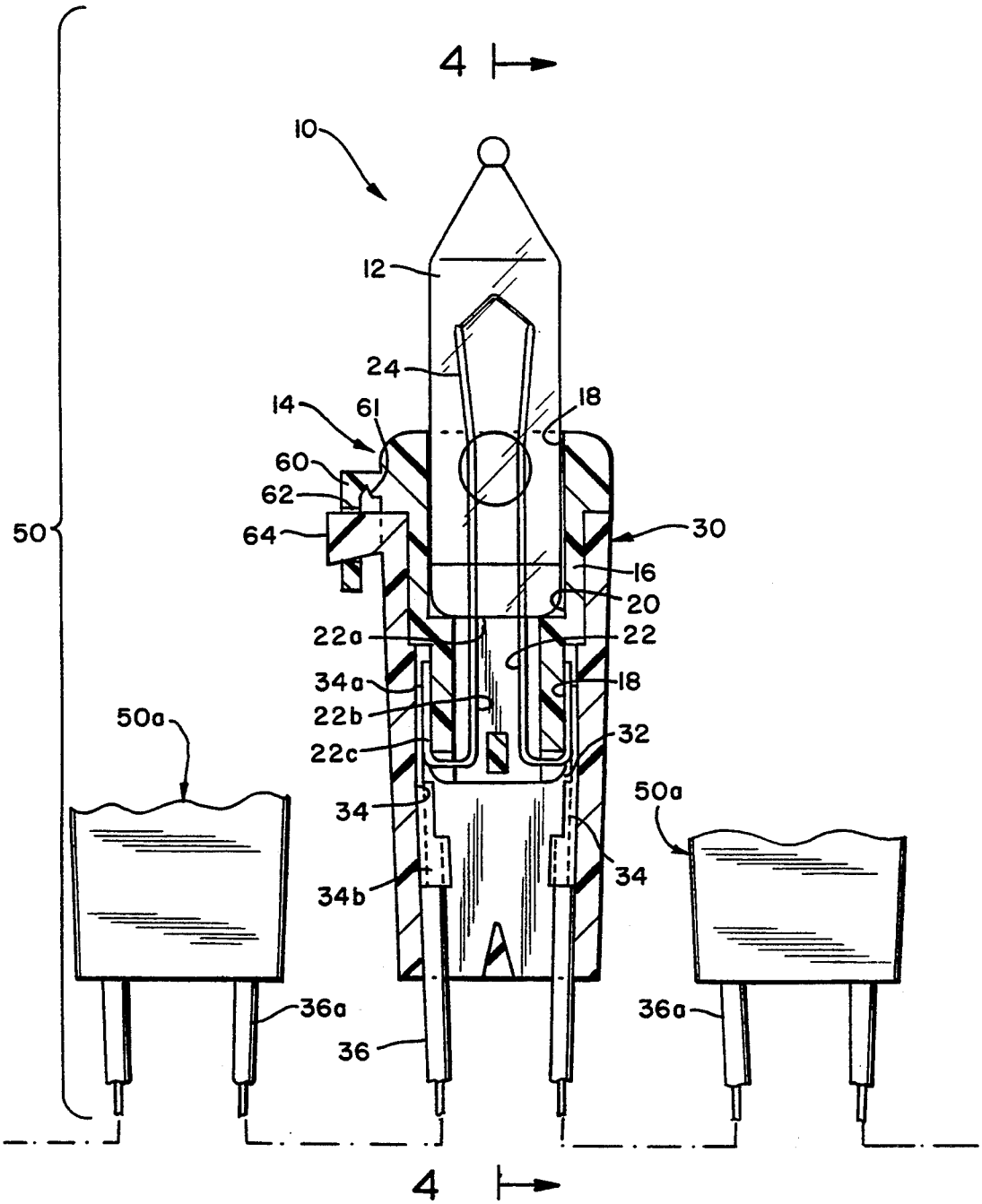
FIG. 3 is a sectional view of the lamp and holder combination, with the lamp taken along the line 3—3 of FIG. 2 and with the holder connected to other combinations to forth a string or set of combinations.

The lamp 10 further includes a pair of dumet leads 22. As best seen in FIG. 3, each lead 22 includes a first end **22*a* in electrical communication with the electrical circuit 24 of the bulb 12, a body portion 22*b* which extends from the bulb (and more precisely the portion of the bulb 12 in the base cavity 20) through an aperture 26 provided therefor in the base body 16, and a second end 22*c* disposed on the base outer surface 18. Typically the leads 22 extend through the bottom of the cavity 20 and then out the bottom of the body 16, where they are reversibly bent and extend upwardly along a small, flat, outer side surface 28** of the wedged-shaped body bottom, ready for engagement with the contacts of the holder.

The base cavity 20 only loosely engages the bulb 12 so that, excluding the binding effect of the leads 22, the bulb 12 and base 14 are capable of relative rotation and, even when the effect of the leads 22 is considered, they are still capable of limited relative rotation.

Referring now to FIGS. 3 and 4 as well, therein illustrated is a holder, generally designated 30, defining an open-top cavity 32 configured and dimensioned to releasably receive a bottom portion of the push-in lamp 10 therein, thereby to form a lamp/holder combination 50. More particularly, the holder cavity 32 is configured and dimensioned to receive the wedged-shaped bottom portion of the base body 16 within the holder cavity 32, along with the portion **22*c* of the lamp leads 22 disposed on the body outer surface 18. Holder contacts 34 disposed within the holder 30 are in electrical communication at one end 34*a* with the lamp leads 22 when the base 14 is received within the holder cavity 32 and at the other end 34b with flexible holder leads 36 connected to a power source (not shown) either directly or indirectly via a plurality of other lamp/holder combinations 50*a* via their holder leads 36*a*** (e.g., as fouled in the conventional Christmas tree light set).

Further details of the above-identified elements are not warranted as these elements are conventional in the miniature lamp art and well-known to those skilled in that art.

Turning now to the novel aspects of the present invention, the base 14 additionally includes a cantilever, generally designated 40, projecting generally longitudinally from the body 16 (i.e., generally parallel to the longitudinally axis of the body 16). More particularly, the cantilever 40 extends longitudinally from adjacent the top of the body 16 downwardly and terminates in a free end 42. The base 14 defines an aperture 44 aligned with the cantilever free end 42 so that the cantilever free end 42 may pass through the base body 16 and enter base cavity 20 so as to contact the bulb 12 when the cantilever 40 is in the locking orientation described below. Preferably, a diametrically opposed pair of the cantilevers 40 (and aligned apertures 44) are provided, although one cantilever may suffice for smaller bulbs and a greater number of circumferentially spaced apart cantilevers may be provided for larger bulbs.

Each cantilever 40 is movable between a releasing orientation illustrated in FIGS. 1–2 and a locking orientation illustrated in FIGS. 3–4, it being understood that the difference between the releasing and locking orientations has been exaggerated for expository purposes.

The cantilever 40 in the releasing orientation enables at least limited relative rotation of the bulb 12 and the base 14 (and in particular the body 16 of the base 14) and in the locking orientation precludes such relative rotation. More particularly, in the locking orientation the cantilever free end 42 enters base body aperture 44 and frictionally engages the bulb 12 to preclude such relative rotation.

The cantilever 40 is biased to the releasing orientation (for example, by the living hinge 41 connecting it to the base body 16), but automatically assumes the locking orientation when the base 14 is inserted into a holder 30 (and in particular the holder cavity 32). The outer surface of the cantilever 40 is preferably tapered inwardly adjacent to its free end 42 to facilitate entry of the cantilever 40 into the holder cavity 32 as it is cammed inwardly by the holder 30.

Because the cantilever 40 is connected to the base body 16 by only a single living hinge 41, the free end 42 thereof is easily displaced from the releasing orientation to the locking orientation. Accordingly, the process of insertion of the base 14 into its holder 30 will generally be continued until the base 14 is fully seated within (that is, inserted to the appropriate depth into) the holder 30. Thus both an effective electrocommunication between the dumet leads 22 and the holder contacts and a secure physical engagement between base 14 and holder 30 is easily and rapidly effected by the consumer.

Furthermore, because the cantilever 40 can undergo a greater angular displacement at its free end (typically about 9° between the releasing and locking orientations), it is more easily capable of accommodating the variations found in commercial push-in miniature bulbs than a locking strip secured to the base body at both ends, thereby to more effectively preclude relative rotation between the bulb and the base when the cantilever is in the locking orientation.

Finally, the base 14 according to the present invention (i.e., with the cantilever 40) is more easily injection-molded than a similar base having a locking strip secured to the base body at both ends.

Preferably the cantilever 40 in the releasing orientation is generally parallel to the longitudinal axis of the base 14, although its outer surface may be somewhat inclined thereto in places. The longitudinal axis of the cantilever 40 in the locking orientation preferably forms an angle of from 6° to 12° with the longitudinal axis of the base 14. The thickness of the cantilever 40 at its free end 42 is selected so that the cantilever 40 in the releasing orientation does not impede initial insertion of the bulb 12 into the base 14 before the lamp 10 is inserted into the holder 30, yet extends into the base 14 sufficiently to contact and immobilize the bulb 12 against rotation relative to the base 14 when the lamp 10 is inserted into holder 30.

While the lamp 10 of the present invention has been described in terms of a cantilever 40 extending downwardly from the base body 16 (away from the bulb end), the same principles would apply to a cantilever 40 which extended upwardly from the base body 16 (towards the bulb end). Indeed, it is contemplated that a lamp having one or more upwardly-extending cantilevers might be even easier to insert within a holder 30 as the sidewalls of the holder cavity 32 would automatically cam the upwardly-extending cantilevers inwardly during the insertion process. Additionally, while the outer surface of a downwardly-extending cantilever 40 must be carefully tapered to insure its easy entry into the holder cavity 32, this is less of a problem with an upwardly-extending cantilever. On the other hand, a base with an upwardly-extending cantilever is more difficult to injection mold than a base with a downwardly-extending cantilever. Furthermore, there is some theoretical danger that, where the bulb 12 has a rounded base portion, the upward and inward motion of the upwardly-extending cantilever might act on such rounded bulb portion so as to accidentally force the bulb 12 upwardly relative to the base 14 as the lamp 10 was being inserted into the holder 30, Thus, on balance, the downwardly-extending cantilever 40 is preferred over the upwardly-extending cantilever.

As illustrated in FIGS. 3–5, the present invention further encompasses the combination 50 of the lamp 10 and the holder 30, the base 14 of the lamp 10 being at least partially disposed in the holder cavity 32 and the cantilever 40 belong held in the locking orientation by the holder 30.

As illustrated in FIG. 3, the present invention additionally encompasses a string of the lamp/holder combinations 50, **50*a* which are both physically and electrically interconnected by means of the holder leads 36, 36*a*** to form a light set, such as a Christmas tree light set.

It will be appreciated that the combination of the lamp 10 and holder 30 may optionally include the mechanism described in U.S. Pat. No. 5,001,615 for preventing accidental dislodgement of the lamp 10 from the holder 30. Thus, as illustrated in FIGS. 1 and 3, the base 14 additionally defines a depending finger 60 pivotable relative to the base body 16 about a living hinge 61 and having an aperture 62 adjacent its free end. The holder 30 defines an outwardly projecting and preferably tapered lug 64 configured and dimensioned to be snugly but releasably received within the aperture of the free end of the finger, thereby to prevent accidental dislodgement of the base from the holder. Further details of the lamp/holder locking mechanism are set forth in the aforementioned U.S. Pat No. 5,001,615.

In a preferred embodiment of the present invention, the outer surface of each cantilever 40 defines a very thin outwardly-extending protrusion 46. Preferably the protrusion 46 extends outwardly about 0.15 mm and has a maximum thickness or width (i.e., thinness) of about 0.50 mm. When a thick bulb 12 is disposed in the base 14, the insertion of the lamp 10 into the holder 30 causes the upper surface of the holder 30 to compress the thin protrusion 46 during the insertion process. On the other hand, when a thin bulb 12 is used, as the lamp 10 is inserted into the holder 30, the protrusion 46 on the outer surface of the base 14 causes the cantilever 40 to pivot further inwardly at its free end 42 so that the presence of the protrusion 46 causes the cantilever free end 42 to contact even a thin bulb 12, thereby precluding rotation of the bulb 12 relative to the base 14. The protrusion 46 on the cantilever 40 serves as a crude spring enabling the base 14 to accommodate bulbs 12 having a relatively wide range of diameters—for example, from 4.7 to 5.4 mm—and preclude rotation thereof relative to the base 14 after the base 14 is inserted into the holder 30.

To summarize, the present invention provides a miniature lamp for use in a holder wherein relative rotation of the bulb and the base body is precluded when the base is inserted within a holder, the lamp being easily insertable into the holder to the desired depth. The base can accommodate minor variations in bulb diameter and still preclude the aforementioned relative rotation once the base is within the holder. The lamp is easy and inexpensive to manufacture, use and maintain.

Now that the preferred embodiments of the present invention have been shown and described in detail, various modifications and improvements thereon will become readily apparent to those skilled in the art. Accordingly, the spirit and scope of the present invention is to be interpreted broadly and limited only by the appended claims, and not by the foregoing specification.

I claim:

1. A miniature lamp for use in a holder, comprising an assembly of:

(A) a miniature bulb;

(B) a longitudinally-extending base including:

(i) a body defining an outer surface and an open-top cavity receiving a portion of said bulb therein, and (ii) a cantilever projecting generally longitudinally from said body and terminating in a free end disposed adjacent said bulb, said cantilever being movable between a releasing orientation and a locking orientation, said cantilever in said releasing orientation enabling at least limited relative rotation of said bulb and said base and in said locking orientation precluding such relative rotation, said cantilever being biased to said releasing orientation and automatically assuming said locking orientation when said base is inserted into a holder; and (C) dumet leads extending from said bulb portion in said cavity, through said body, and onto said body outer surface.

2. The lamp of claim 1 wherein said cantilever is a finger pivotally secured to said body by a living hinge, extends longitudinally from adjacent the top of said body downwardly and terminates in said free end.

3. The lamp of claim 2 wherein in said locking position said cantilever free end frictionally engages said bulb to preclude relative rotation of said bulb and said base.

4. The lamp of claim 1 including a diametrically opposed pair of said cantilevers.

5. The lamp of claim 1 in combination with a holder therefor, said base being disposed in said holder and said cantilever being held in said locking orientation by said holder.

6. The lamp of claim 1 including compressible projecting means on said cantilever for functioning as a spring and enabling said cantilever in said locking orientation to preclude such relative rotation with bulbs of differing diameters.

7. The lamp of claim 6 wherein said compressible projecting means extends outwardly from an outer surface of said cantilever.

8. A miniature lamp for use in a holder, comprising:

(A) a miniature bulb;

(B) a longitudinally-extending base including:

(i) a body defining an outer surface and an open-top cavity receiving a portion of said bulb therein, and (ii) a cantilever projecting generally longitudinally from adjacent the top of said body downwardly and terminating in a free end adjacent said bulb, said cantilever being movable between a releasing orientation and a locking orientation, said cantilever in said releasing orientation enabling at least limited relative rotation of said bulb and said base and in said locking orientation said cantilever free end frictionally engaging said bulb to preclude such relative rotation, said cantilever being biased to said releasing orientation and automatically assuming said locking orientation when said base is inserted into a holder; and (C) dumet leads extending from said bulb portion in said cavity, through said body, and onto said body outer surface.

9. The lamp of claim 8 in combination with a holder therefor, said base being disposed in said holder and said cantilever being held in said locking orientation by said holder.

10. In combination, a lamp and a holder therefor, said lamp comprising an assembly of:

(A) a miniature bulb;

(B) a longitudinally-extending base including:

(i) a body defining an outer surface and an open-top cavity receiving a portion of said bulb therein, and (ii) a cantilever in the form of a pivotable finger projecting generally longitudinally from adjacent the top of said base body downwardly and terminating in a free end disposed adjacent said bulb, said cantilever being movable between a releasing orientation and a locking orientation, said cantilever in said releasing orientation enabling at least limited relative rotation of said bulb and said base and in said locking orientation having said cantilever free end physically contact and frictionally engage said bulb to preclude such relative rotation, said cantilever being biased to said releasing orientation and automatically assuming said locking orientation when said base is inserted into said holder; and (C) dumet leads extending from said bulb portion in said base cavity, through said base body, and onto said base body outer surface; and said holder comprising:

(A) an insulative body defining an open-top cavity receiving a portion of said base therein and maintaining said cantilever in said locking orientation;

(B) conductive contacts in electrical contact with said dumet leads within said holder cavity; and (C) conductive leads in electrical contact with said conductive contacts within said holder body and extending outwardly from said holder body.

11. The combination of claim 10 wherein said cantilever is a finger pivotally secured to said body by a living hinge, extends longitudinally from adjacent the top of said body downwardly and terminates in said free end.

12. The combination of claim 10 wherein in said locking position said cantilever free end physically contacts and frictionally engages said bulb to preclude relative rotation of said bulb and said base.

13. The combination of claim 10 including a diametrically opposed pair of said cantilevers.

14. The combination of claim 10 additionally including means for releasably locking said base and said holder together.

15. The combination of claim 10 including compressible projecting means on said cantilever for functioning as a spring and enabling said cantilever in said locking orientation to preclude such relative rotation with bulbs of differing diameters.

16. In combination, a lamp and holder therefor, said lamp comprising an assembly of:

(A) a miniature bulb;

(B) a longitudinally-extending base including:

(i) a body defining an outer surface and an open-top cavity receiving a portion of said bulb therein, and (ii) a cantilever projecting generally longitudinally from adjacent the top of said base body downwardly and terminating in a free end, said cantilever being movable between a releasing orientation and a locking orientation, said cantilever in said releasing orientation enabling at least limited relative rotation of said bulb and said base and in said locking orientation said cantilever free end physically contacting and frictionally engaging said bulb to preclude such relative rotation, said cantilever being biased to said releasing orientation and automatically assuming said locking orientation when said base is inserted into a holder; and (C) dumet leads extending from said bulb portion in said base cavity, through said base body, and onto said base body outer surface; and said holder comprising:

(A) an insulative body defining an open-top cavity receiving a portion of said base therein and maintaining said cantilever in said locking orientation;

(B) conductive contacts in electrical contact with said dumet leads within said holder cavity; and (C) conductive leads in electrical contact with said conductive contacts within said holder body and extending outwardly from said holder body.

17. A set of lights comprising: a plurality of the combinations of claim 10 physically and electrically interconnected by said holder leads.

18. A set of lights comprising: a plurality of the combinations of claim 16 physically and electrically interconnected by said holder leads.

* * * * *